US008602046B2

(12) United States Patent
Eriksen

(10) Patent No.: US 8,602,046 B2
(45) Date of Patent: Dec. 10, 2013

(54) METHOD AND A DEVICE FOR THE CLEANING OF A PISTON-BASED HYDRAULIC ACCUMULATOR

(75) Inventor: Egil Eriksen, Foldrøyhamn (NO)

(73) Assignee: Tool-Tech AS, Rykkinn (NO)

( * ) Notice: Subject to any disclaimer, the term of this patent is extended or adjusted under 35 U.S.C. 154(b) by 236 days.

(21) Appl. No.: 13/061,074

(22) PCT Filed: Aug. 28, 2009

(86) PCT No.: PCT/NO2009/000303
§ 371 (c)(1),
(2), (4) Date: May 13, 2011

(87) PCT Pub. No.: WO2010/024692
PCT Pub. Date: Mar. 4, 2010

(65) Prior Publication Data

US 2011/0214743 A1 Sep. 8, 2011

(30) Foreign Application Priority Data

Aug. 29, 2008 (NO) ..... 20083748

(51) Int. Cl.
*B08B 3/00* (2006.01)

(52) U.S. Cl.
USPC ... 137/15.05; 137/237; 137/813; 137/599.03; 138/31

(58) Field of Classification Search
USPC ..... 137/15.01, 15.04, 15.05, 237, 238, 808, 137/809, 812, 813, 599.01, 599.03, 602, 137/605; 138/31; 15/3.5, 104.061, 246.5
See application file for complete search history.

(56) References Cited

U.S. PATENT DOCUMENTS 2,828,760 A * 4/1958 Desmond et al. ..... 137/115.26
3,331,117 A * 7/1967 Jacobellis ..... 29/890.06

(Continued)

FOREIGN PATENT DOCUMENTS

DE 4337380 A1 5/1995
EP 0854296 A2 7/1998

(Continued)

OTHER PUBLICATIONS

International Search Report for International Patent Application No. PCT/NO2009/000303 dated Oct. 28, 2009.

*Primary Examiner* — Craig Schneider
*Assistant Examiner* — Ian Paquette
(74) *Attorney, Agent, or Firm* — Patterson & Sheridan, LLP

(57) ABSTRACT

The invention relates to a method of using new flushing ports (1A, 1B) when cleaning a piston accumulator (7). Dirty hydraulic oil is returned out via the main port (2) and a return passage (9) until a cleanness grade has been reached. Clean hydraulic oil is forced into the piston accumulator (7) via the axial bores (3A, B) of the flushing ports (1A, B) and further in sloping bores (3C, D), bringing the hydraulic oil into the volume (8) in an upward, tangential direction below the piston (5), into a flushing circulation. By reducing the gas pressure on the gas side (4) of the piston (5) in relation to flushing pressure input from a valve (6), a volume (8) is created on the oil side between the piston (5) and the end bottom (3). The return passage (9) is closed and the piston (5) is brought into its upper position, so that an internal cylinder wall (10) is cleaned. Upon pressure build-up, the return passage (9) is opened, and the piston (5) returns to its end position on the oil side while the supply of clean hydraulic oil is maintained, and the operation is repeated until a clean-ness grade has been achieved.

3 Claims, 2 Drawing Sheets

(56) References Cited

U.S. PATENT DOCUMENTS

| | | | | | |
|---|---|---|---|---|---|
| 4,186,777 | A | * | 2/1980 | Klope et al. | 138/31 |
| 4,966,200 | A | * | 10/1990 | Bents | 138/31 |
| 5,311,910 | A | * | 5/1994 | Hasegawa et al. | 138/31 |
| 5,353,840 | A | * | 10/1994 | Paley et al. | 138/31 |
| 5,505,262 | A | * | 4/1996 | Cobb | 166/312 |
| 6,866,066 | B2 | * | 3/2005 | Weber | 138/31 |
| 2008/0314467 | A1 | * | 12/2008 | Gray, Jr. | 138/31 |

FOREIGN PATENT DOCUMENTS

| | | | |
|---|---|---|---|
| GB | 846307 | A | 8/1960 |
| WO | 2006079931 | A1 | 8/2006 |

* cited by examiner

METHOD AND A DEVICE FOR THE CLEANING OF A PISTON-BASED HYDRAULIC ACCUMULATOR

The invention relates to a method and a device for cleaning a piston-based hydraulic accumulator.

Today, cleaning is carried out by washing/flushing piston accumulators by repeatedly pumping hydraulic fluid into and letting hydraulic fluid out of the accumulator, until the hydraulic fluid comes out clean.

From the patent literature are cited as the background art:

WO 2006/079931 A1 disclosing flushing of accumulated particles, typically sand, from the bottom of a process container without a piston, the particles being brought against the accumulator wall in a rotating, vortex-like flow pattern.

DE 4337380 A1 disclosing a cleaning device for cleaning drain pipes.

EP 0854296 B1 dealing with a particular accumulator, in which a sealing medium in the space between two piston parts of a double piston is compressed by a biasing spring. This medium functions together with the piston seals as a seal between the hydraulic side and the gas side.

GB 846307 A1 disclosing a special accumulator with an integrated filter device at the hydraulic oil side to avoid having a separate high-pressure filter housing, by using a lower end of the accumulator as a filter housing.

Running the piston cyclically in connection with cleaning of the piston-based hydraulic accumulator has several drawbacks:

1. It is a time-consuming operation, getting the particle contents of the accumulator down to a desired cleanness grade by running the piston.

2. There is a problem getting remains of dirt accumulating at the bottom of the accumulator out by known methods.

3. Long-duration running of the piston gives wear, and wear from the piston also causes particles to mix into the hydraulic fluid.

4. There is a risk of galling between the piston and cylinder wall, and it has happened that accumulators have become ruined during flushing, because of this operation.

Thus, there is a need for a more effective method of cleaning piston-based hydraulic accumulators, reducing the wear from the piston at the same time.

According to the invention, the method and the device provide for an improved cleaning of piston accumulators in connection with a flushing of hydraulic systems.

The present inventive method and device make use of novel flushing port(s) or duct(s) when cleaning a piston accumulator in which clean hydraulic oil is forced into the piston accumulator via axial bores of the flushing port(s) and further on in sloping bores, bringing said clean hydraulic oil into a volume of the piston accumulator in an upward, tangential direction below a piston of the piston accumulator, to bring a flushing hydraulic oil comprising the clean hydraulic oil and a polluted hydraulic oil into a flushing circulation, and returning the polluted hydraulic oil out via a main port and a return passage until a cleanness grade has been reached. By reducing a gas pressure on a gas side of the piston in relation to a flushing pressure input from a valve, the volume is created on an oil side between the piston and an end bottom. Further, the return passage is closed and the piston is brought into its upper position, so that an internal cylinder wall is cleaned, and that upon pressure build-up, the return passage is opened and the piston returns to its end position on the oil side while a supply of clean hydraulic oil is maintained. The operation is repeated until a desired grade of cleanness has been achieved.

Figure 1:
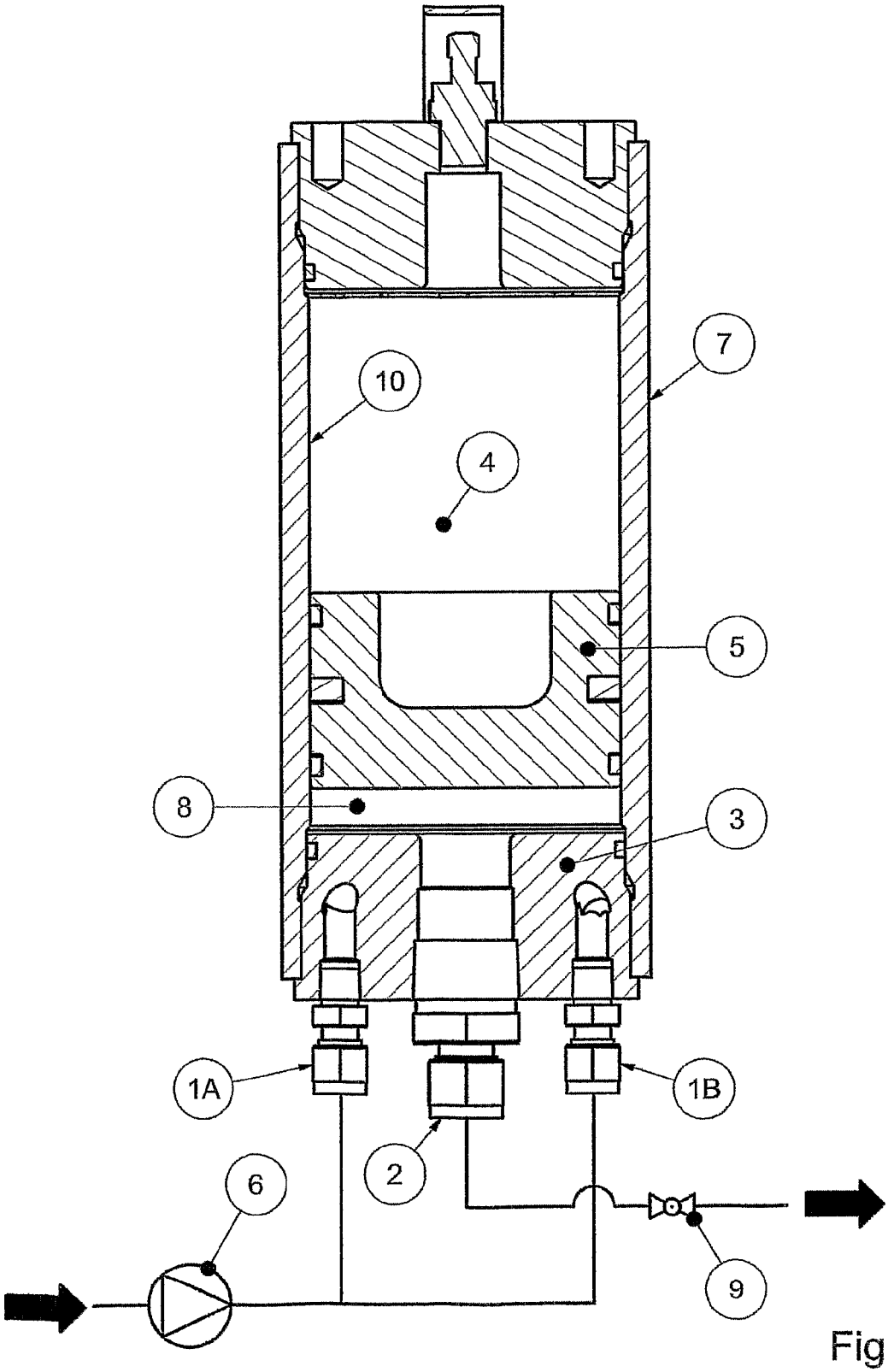
FIG. 1 shows a sectional side view of a piston-based hydraulic accumulator with an associated flushing pressure input valve and a return passage.
Figure 2C:
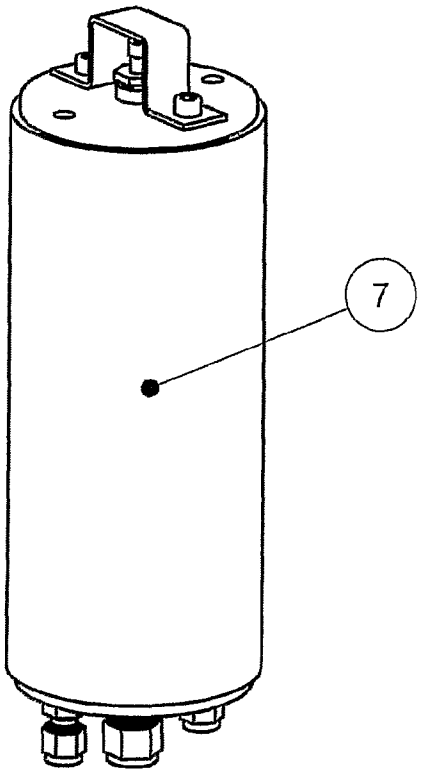
FIG. 2C is a perspective view of the piston-based hydraulic accumulator.
Figure 2A:
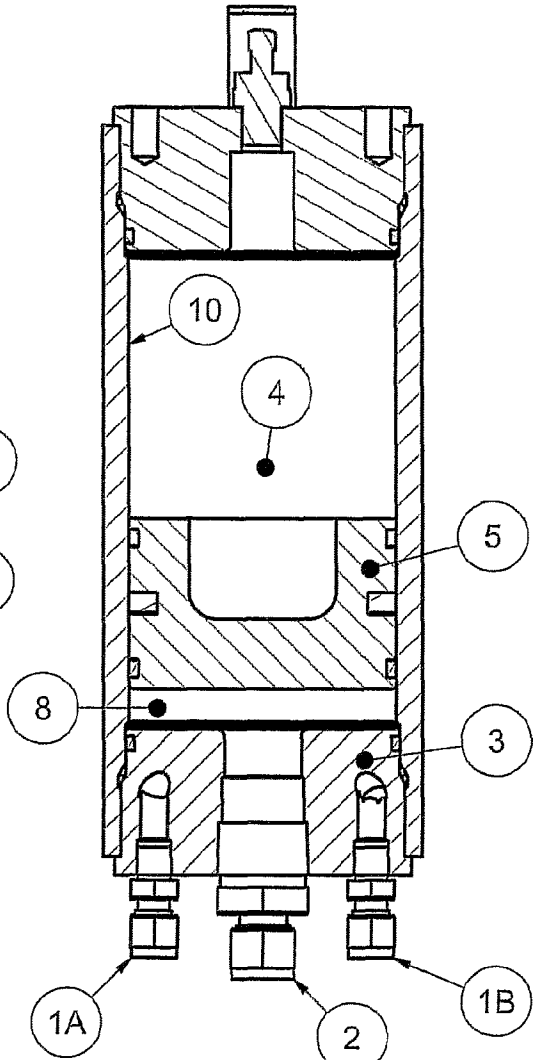
FIG. 2A is the sectional side view of the piston-based hydraulic accumulator of FIG. 1.

FIGS. 1 and 2 show a piston-based hydraulic accumulator 7 with a piston 5 which is movable in a cylinder space. The piston 5 has a fluid side facing a fluid volume 8 of the cylinder space and a gas side facing a gas volume 4 of the cylinder space. The piston-based hydraulic accumulator 7 has an end bottom 3, i.e. a bottom wall, facing the fluid side of the piston 5, and a top wall facing the gas side of the piston 5. An internal cylinder wall 10 is present between the end bottom 3 and said top wall and defining thereby the cylinder space. At least one hydraulic fluid flushing port or duct 1A; 1B extends through the end bottom 3, the at least one flushing port or duct 1A; 1B having in series an axially extending bore 3A; 3B with a fluid input and a sloping bore 3C; 3D with a fluid output into the fluid volume 8 of the cylinder space. A flushing fluid supply input valve 6 is in communication with said fluid input of the at least one flushing port or duct 1A; 1B. A main duct 2 extends axially through the end bottom 3 and at an outside thereof being enabled to be in communication with a fluid return passage 9.

Figure 2B:
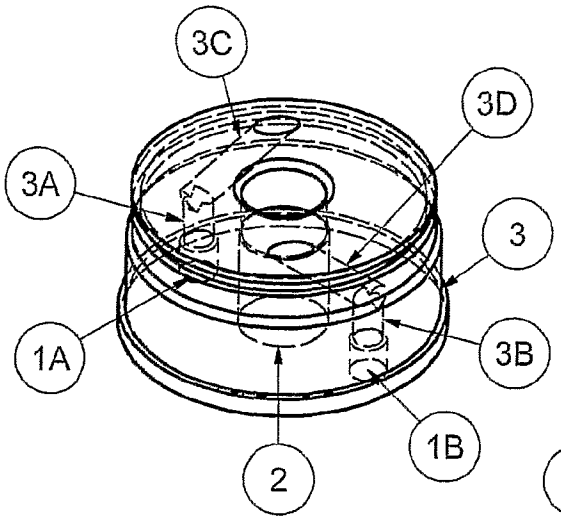
FIG. 2B is a perspective view of an end bottom of the piston-based hydraulic accumulator.

FIG. 2B shows in 3D-like perspective view the end bottom 3, i.e. the bottom wall, of the piston-based hydraulic accumulator 7 and how a flushing fluid can be brought into circulation from two novel flushing ports 1A and 1B in that bores 3A, 3B in the end bottom 3 which are directed upwards are provided in axial direction in the end bottom 3 of the piston-based hydraulic accumulator 7, meeting sloping bores 3C, 3D, respectively, directed downwards in the material of the end bottom 3 from a top side of the end bottom 3. These straight bores 3A; 3B and sloping bores 3C; 3D thus form two flushing ports or ducts 1A; 1B extending in pairs through the end bottom 3. When the clean hydraulic fluid enters at the oil side of the piston-based hydraulic accumulator 7 via the flushing ports or ducts 1A, 1B and changes its direction via the sloping bores 3B; 3C, so that it meets the internal cylinder wall 10 and a bottom side of the piston 5 in a partially upward and tangential direction, hydraulic fluid in the fluid volume 8 below the piston 5 (between the piston 5 and the end bottom 3) is brought to rotate in a vortex and the hydraulic fluid has its outlet through the main duct 2 axially and centrally located in the end bottom 3. This contributes to efficiently flushing particles out from the fluid volume 8 of the piston-based hydraulic accumulator 7.

The gas pressure on the gas side 4 of the piston 5 is reduced in relation to the flushing pressure input from the flushing pressure input valve 6 to the piston-based hydraulic accumulator 7. The gas is compressed somewhat, so that there will be the fluid volume 8 on the oil side, i.e. between the piston 5 and end bottom 3.

Clean hydraulic oil is forced into the piston-based hydraulic accumulator 7 via the flushing ports or ducts 1A and 1B, bringing the oil in the fluid volume 8 below the piston 5 into circulation at great velocity, and dirty oil is returned out via the main duct 2. When a desired cleanness grade has been achieved, the fluid return passage 9 is closed, so that the piston 5 compresses gas on the gas side 4 of the piston 5 and the piston 5 reaches its upper position. This cleans the internal cylinder wall 10 internally.

On pressure build-up, the fluid return passage 9 is opened and the piston 5 is allowed to return to its end position on the oil side while the supply of clean hydraulic oil is maintained, and the cleaning operation is repeated until the desired cleanness grade has been achieved.

The invention claimed is:

1. A method of cleaning a piston based hydraulic accumulator, the accumulator comprising:

a piston movable in a cylinder space, the piston having a hydraulic fluid side facing a hydraulic fluid volume of the cylinder space and a gas side facing a gas volume of the cylinder space;

a bottom wall facing the hydraulic fluid side of the piston;

a top wall facing the gas side face of the piston;

an internal cylinder wall between the bottom wall and the top wall and defining therewith the cylinder space;

at least one hydraulic fluid flushing duct extending through the bottom wall, the at least one hydraulic fluid flushing duct having in series an axially extending bore with a clean fluid input and a sloping bore with a clean fluid output opening into the hydraulic fluid volume of the cylinder space;

a clean hydraulic fluid supply input valve being in communication with the clean fluid input of the at least one hydraulic fluid flushing duct;

a main duct extending axially through the bottom wall and at an outside thereof being in communication with a hydraulic fluid return passage, wherein the method comprises the steps of:

(a) creating a flushing hydraulic fluid vortex within the hydraulic fluid volume present between the hydraulic fluid side and the bottom wall by forcing a clean hydraulic fluid through the axial bore and thereafter through the sloping bore such that the clean hydraulic fluid enters the hydraulic fluid volume and meets the internal cylinder wall and the hydraulic fluid side of the piston in an upward, tangential-like direction, causing a flushing hydraulic fluid comprising the clean hydraulic fluid and a polluted hydraulic fluid to rotate in the flushing hydraulic fluid vortex, while allowing the flushing hydraulic fluid to return through the main duct and the hydraulic fluid return passage, thereby flushing away particles from a bottom region of the accumulator, and at least partially reducing a pressure in the gas volume in relation to a pressure in the hydraulic fluid volume, although maintaining a gas in the gas volume in a compressed state;

(b) upon obtaining a required cleanness of returned flushing hydraulic fluid, causing closure of the hydraulic fluid return passage to increase pressure within the hydraulic fluid volume until a threshold volume is reached and thereby increase the hydraulic fluid volume so as to move the piston towards an upper position thereof while compressing the gas within the gas volume, thereby cleaning the internal cylinder wall which extends between the piston hydraulic fluid side and the bottom wall;

(c) opening the hydraulic fluid return passage to allow the piston to return to a lower end position in the hydraulic fluid volume caused by pressure of the gas in the gas volume, while supplying the clean hydraulic fluid to the fluid volume and draining the flushing hydraulic fluid via the main duct and the hydraulic fluid return passage until the returned flushing hydraulic fluid has reached a required cleanness; and (d) repeating steps (a) through (c) until the returned flushing hydraulic fluid from the hydraulic fluid volume exhibits a predetermined final state of cleanness.

2. The method according to claim 1, wherein the hydraulic fluid volume comprises hydraulic oil.

3. The method according to claim 1, wherein the bottom wall has two hydraulic fluid flushing ducts, whereby the flushing hydraulic fluid vortex is provided at a high velocity.

* * * * *